US007168386B2

(12) United States Patent
Kochi et al.

(10) Patent No.: US 7,168,386 B2
(45) Date of Patent: Jan. 30, 2007

(54) SMALL BOAT

(75) Inventors: Takao Kochi, Saitama (JP); Masahiko Tsuchiya, Saitama (JP); Hajime Shogase, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/935,077

(22) Filed: Sep. 8, 2004

(65) Prior Publication Data

US 2005/0092224 A1 May 5, 2005

(30) Foreign Application Priority Data

Sep. 9, 2003 (JP) ..... 2003-317503

(51) Int. Cl.

| | |
|---|---|
| ***B63B 39/06*** | (2006.01) |
| ***B63B 1/20*** | (2006.01) |
| ***B63B 35/73*** | (2006.01) |
| ***B63H 11/08*** | (2006.01) |

(52) U.S. Cl. ..... 114/283; 114/55.5; 114/55.54; 114/126

(58) Field of Classification Search ..... 114/55.5, 114/55.54, 121–123, 126–143, 152, 283–286, 114/288–290; D12/307, 309–314
See application file for complete search history.

(56) References Cited

U.S. PATENT DOCUMENTS 5,193,478 A * 3/1993 Mardikian ..... 114/285
5,713,297 A * 2/1998 Tani et al. ..... 114/284
5,908,006 A * 6/1999 Ibata ..... 114/284
6,546,888 B2 * 4/2003 Bertrand et al. ..... 114/126
6,712,016 B1 * 3/2004 Morisch et al. ..... 114/126

FOREIGN PATENT DOCUMENTS

| | | | |
|---|---|---|---|
| JP | 61036087 A | * | 2/1986 |
| JP | 10-76990 A | | 3/1998 |
| JP | 2003175894 A | * | 6/2003 |

* cited by examiner

*Primary Examiner*—Ajay Vasudeva
(74) *Attorney, Agent, or Firm*—Birch, Stewart, Kolasch & Birch, LLP

(57) ABSTRACT

A small boat has left and right sponsons extending in a longitudinal direction and respectively attached to left and right side walls forming a boat body. The sponsons are provided with an attachment section contacting a left side wall, a gliding section extending substantially horizontally from a lower edge of the attachment section, an inclined section connecting to a side edge of the gliding section, an upper edge of the attachment section, and projecting sections extending from an upper edge to a lower edge of the inclined section. Water flowing along the inclined section is guided by the projection sections and removed or separated from the inclined section. Accordingly, a small boat that turns through a small arc turning locus is provided, e.g., a small boat that is capable of relatively tight turning.

17 Claims, 11 Drawing Sheets

SMALL BOAT

CROSS-REFERENCES TO RELATED APPLICATIONS

This nonprovisional application claims priority under 35 U.S.C. § 119(a) on Patent Application No. 2003-317503 filed in Japan on Sep. 9, 2003, the entirety of which is hereby incorporated by reference.

BACKGROUND OF THE INVENTION

1. Field of the Invention

The present invention relates to a small boat or watercraft, and more particularly to a small boat or watercraft having sponsons attached to left and right side walls that form a boat body.

2. Description of the Background Art

A small boat for gliding over the surface of a sea or a lake is known in the background art. A small propelled boat driven by taking in water from the bottom of the boat and spraying the water to the rear as a result of attaching a jet propulsion unit to the rear of the boat body and driving this jet propulsion unit with an engine is one of these types of small boats. This small boat may have sponsons extending longitudinally and being provided on left and right side surfaces of the boat body.

For example, Japanese Patent Laid Open No. Hei. 10-76990 (FIG. 2), the entirety of which is hereby incorporated by reference, depicts a small boat having sponsons as described hereinabove. This type of small boat is described in greater detail hereinafter with respect to the accompanying drawings. FIG. 9 is shows the basic structure of a small boat of the background art. The small boat 100 has a jet propulsion unit 103 provided on the stem 102 of the boat hull 101, and left and right sponsons 106 and 107 are respectively provided on rear sections of left and right side walls 104, 105. By attaching the sponsons 106, 107 on the left and right side walls, the left and right sponsons 106, 107 respectively jut outwards from the side walls 104 and 105.

A water jet is sprayed backwards from a steering nozzle 117 of the small boat 100 and the small boat 100 is moved in a straight line. When the small boat 100 is moving in a straight line, upper parts 108 and 109 of the left and right sponsons 106, 107 lift up from the water surface 111, and respective gliding sections 112 and 113 of the left and right sponsons 106 and 107 come into contact with the water surface 111. In this way, a large surface area of the hull is in contact with the water when the small boat 100 is moving.

FIG. 10(*a*) and FIG. 10(*b*) show an example of a turning operation of the small boat of the background art. In FIG. 10(*a*), during straight line movement of the small boat 100, a rider 115 operates a steering handle 116 as shown by arrows a1 to cause the steering nozzle 117 at the stern 102 to swing as shown by the arrow b1.

In FIG. 10(*b*), by moving the steering nozzle 117 to swing the water jet 118, water from the steering nozzle 117 is sprayed in an inclined direction, as shown by arrow c1. Accordingly, the stern 102 of the hull 101 is made to move in a rightward direction as shown by the arrow d1, and the small boat 100 begins to turn left. The small boat 100 then tilts to the left side, and the left sponson 106 sinks into the water. Therefore, the water resistance in the sideways direction with respect to the left sponson 106 becomes larger, and a movement amount of the stern 102 in the right direction is kept relatively small.

FIG. 11 shows an example of the small boat of the background art during a turning operation. An amount of movement of the stern 102 in the direction of arrow d1 is kept relatively small, and the small boat turns through a large arc as shown by the turning locus 119.

However, the small boat 100 has had many applications in recent years. For this reason, if parts suitable for turning through a large arc turning locus (large turn) or parts suitable for turning through a small arc turning locus (small turn) are provided in the small boat 100, the user selects a desired small boat 100 according to the application. Therefore, in order to allow a small boat to be used with a number of different applications, it is desired to make practical use of a small boat that turns through a small arc turning locus compared to the small boat of the background art.

SUMMARY OF THE INVENTION

The present invention overcomes the shortcomings associated with the background art and achieves other advantages not realized by the background art.

An object of the present invention is to provide a small boat or watercraft that is capable of turning through a relatively small arc turning locus (small turn) when turning.

One or more of these and other objects are accomplished by a watercraft comprising a boat body having left and right side walls extending longitudinally from a front and a rear portion of the boat body; a right side sponson extending longitudinally along the right side wall; and a left side sponson extending longitudinally along the left side wall, wherein the left and right sponsons include attachment sections contacting the respective side walls, runner sections projecting substantially horizontally from a lower edge of the attachment sections, inclined sections connecting to a side edge of the runner sections and an upper edge of the attachment sections, and at least one projection section projecting upwardly from the inclined sections, wherein water flowing along the inclined sections separates from the inclined sections by being guided by the projecting sections.

One or more of these and other objects are accomplished by a sponson for a watercraft, the sponson comprising an attachment section capable of contacting a respective side wall of the watercraft, a runner section projecting substantially horizontally from a lower edge of the attachment section, an inclined section connected to a side edge of the runner section and an upper edge of the attachment section, and at least one projection section projecting upwardly from the inclined section, wherein the at least one projection section is a raised rib extending rearwardly and at an angle with respect to a longitudinal waterline of the sponson.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

DETAILED DESCRIPTION OF THE PREFERRED EMBODIMENTS

Figure 1:
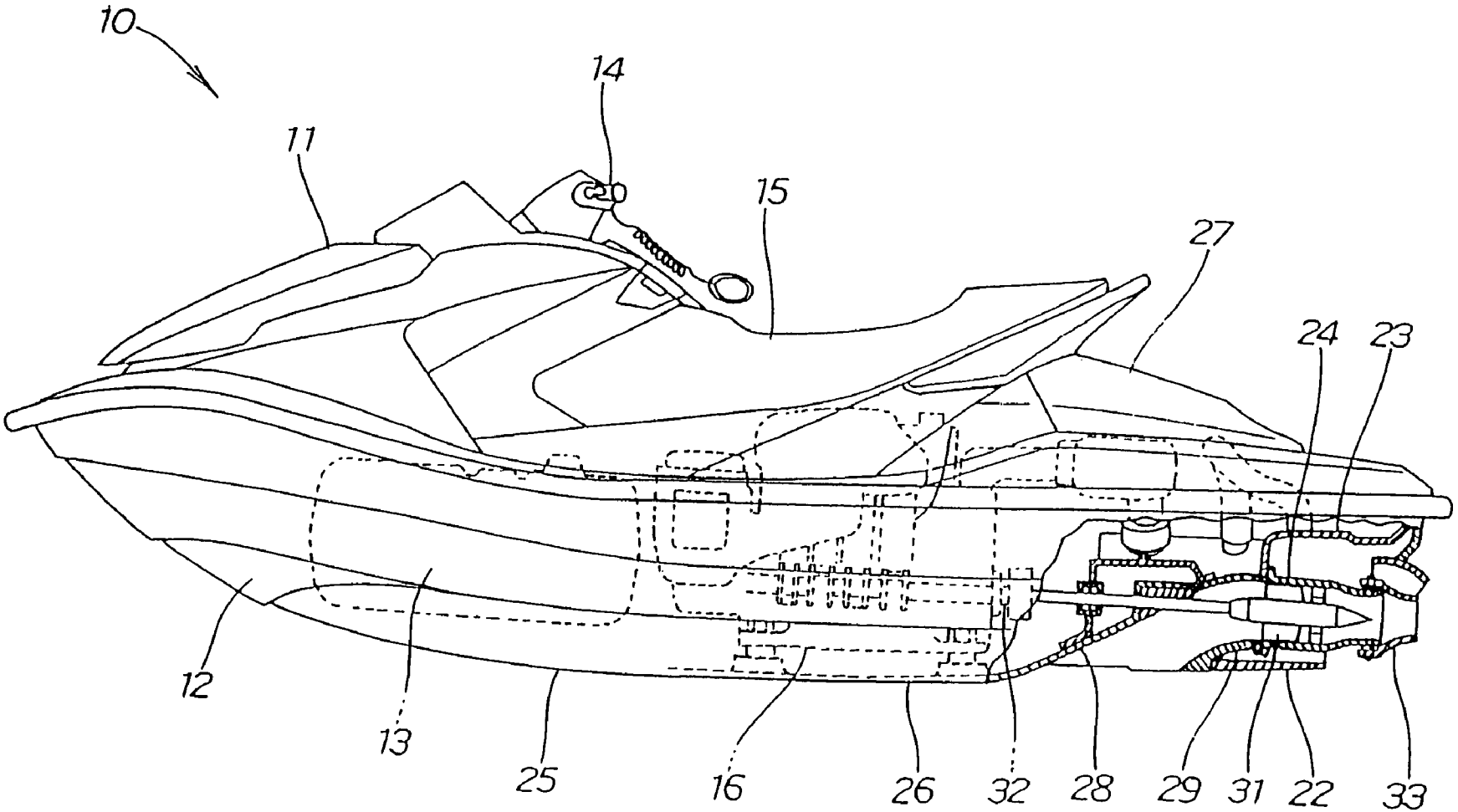
FIG. 1 is a side view of a small boat according to an embodiment of the present invention.
Figure 2:
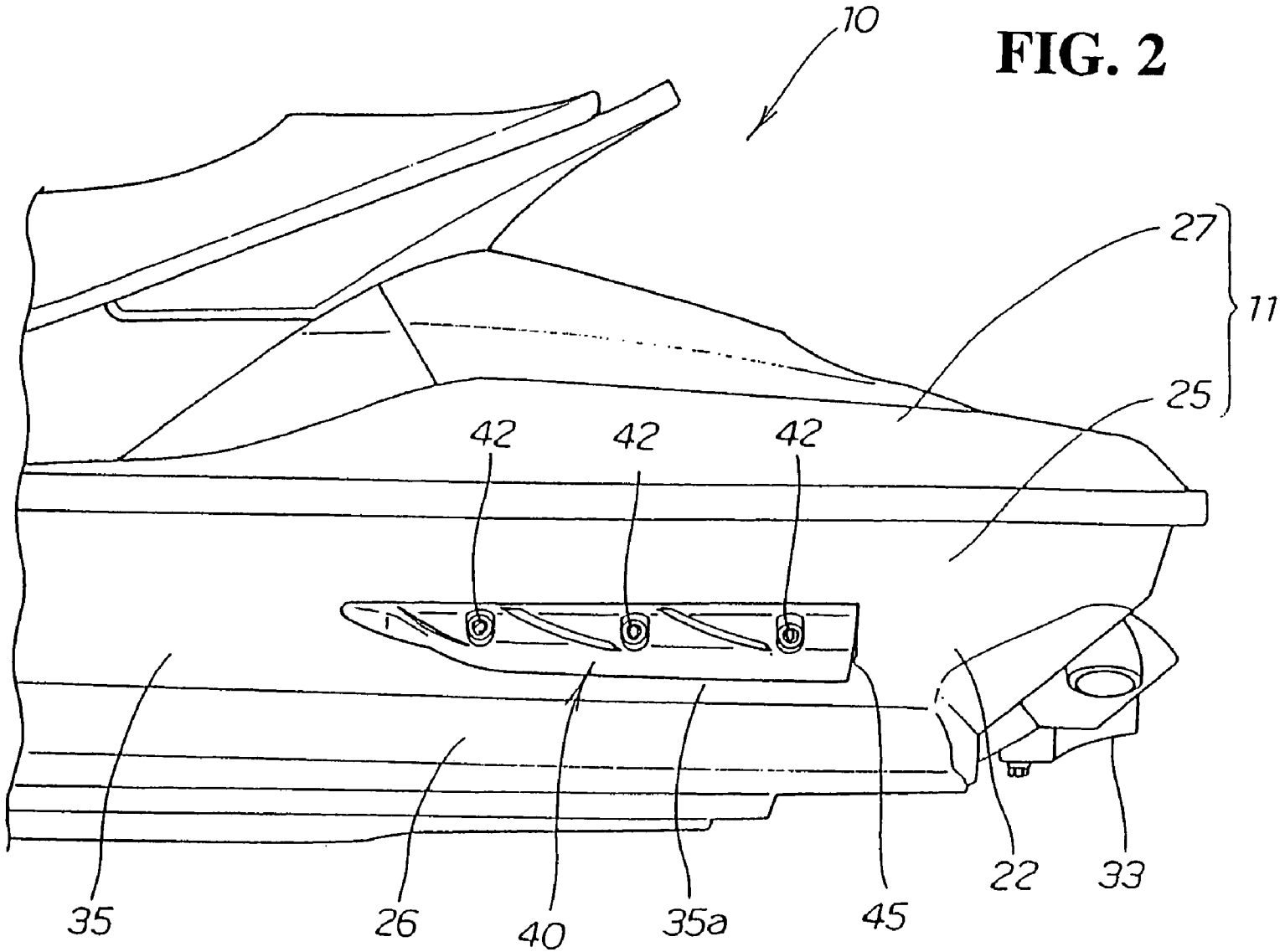
FIG. 2 is a side view showing portions of a small boat according to an embodiment of the present invention.
Figure 3:
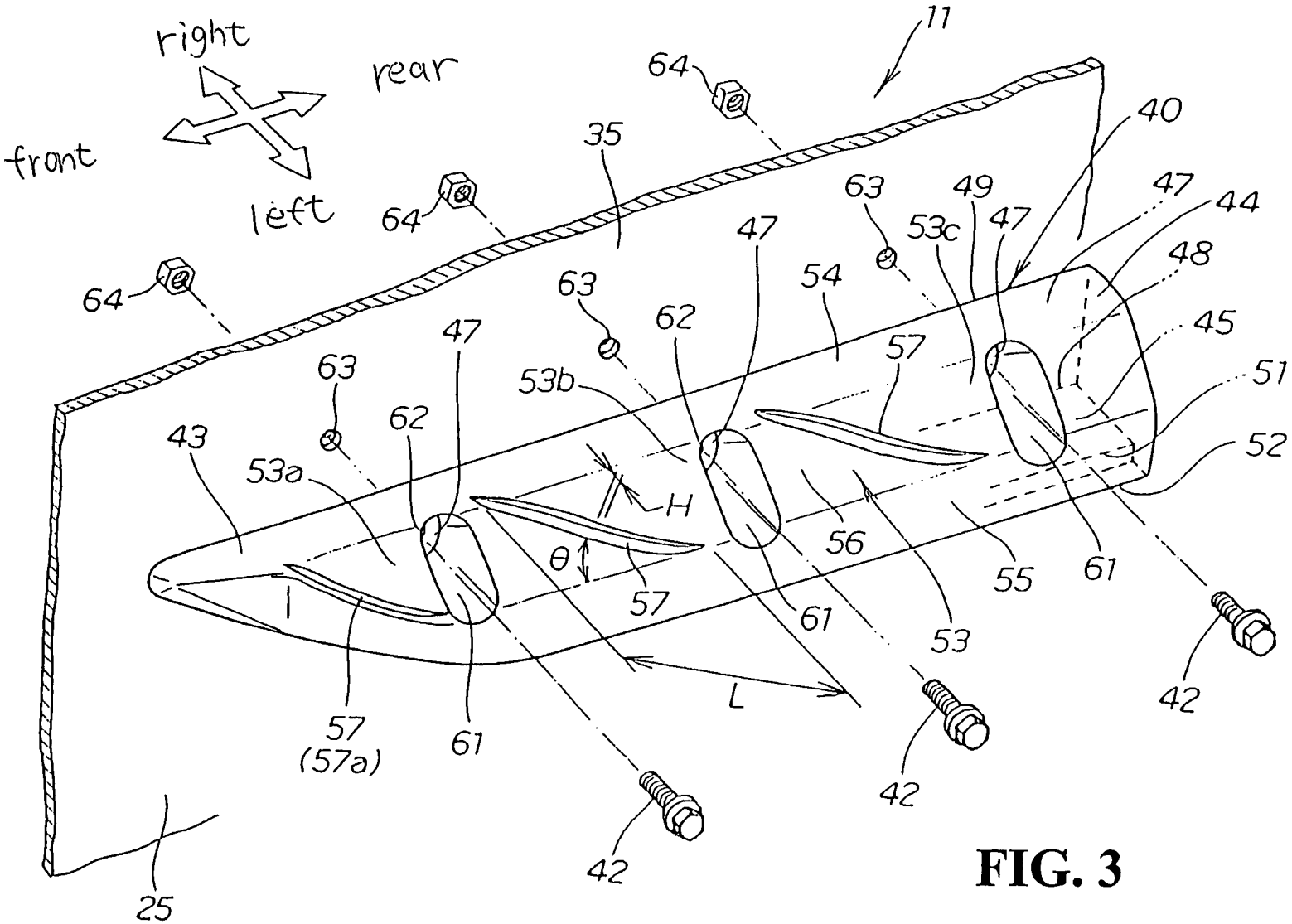
FIG. 3 is a perspective view showing a sponson provided on a small boat according to an embodiment of the present invention.
Figure 4:
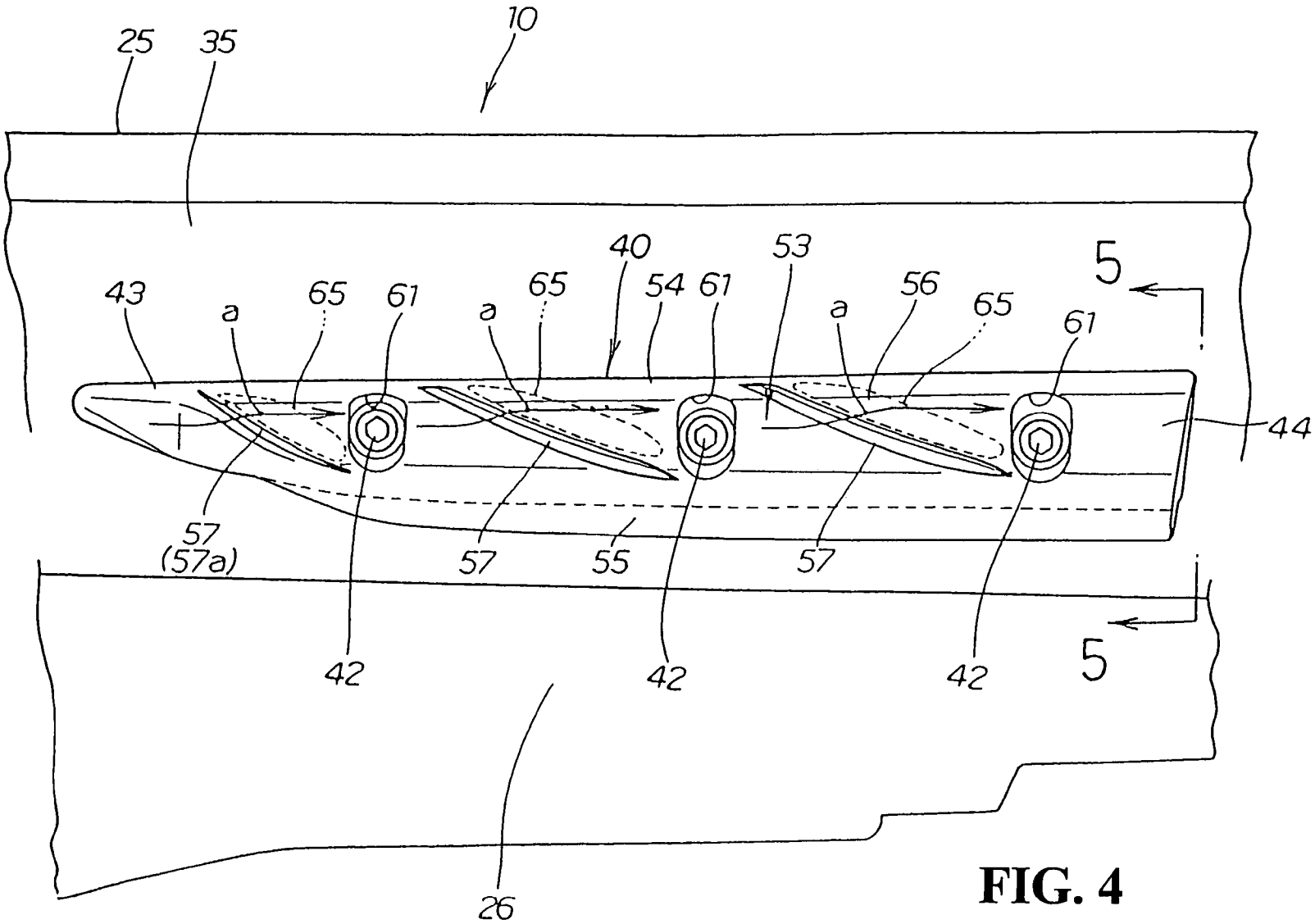
FIG. 4 is a side view showing a sponson provided on a small boat according to an embodiment of the present invention.
Figure 5:
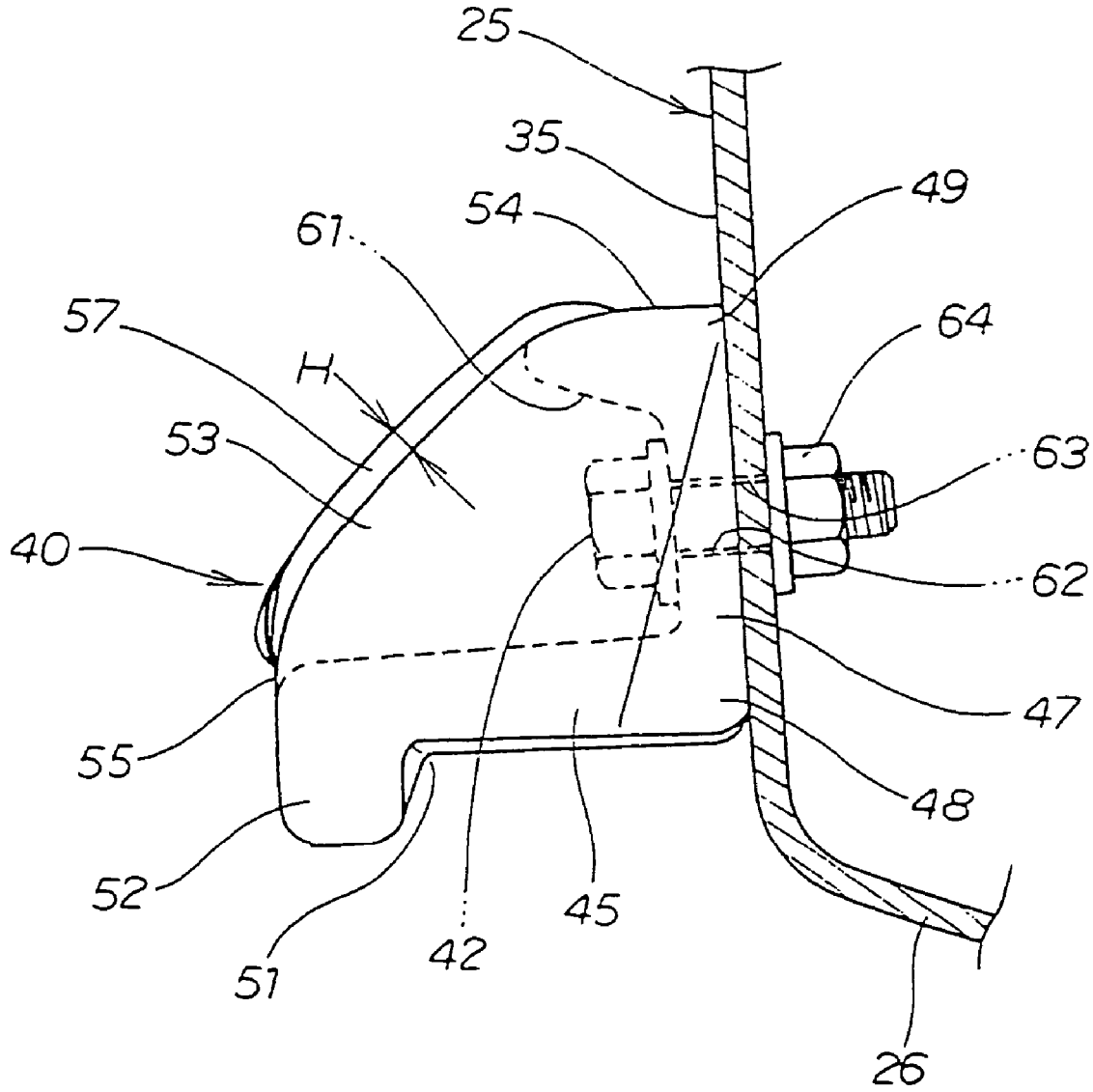
FIG. 5 is a cross sectional view taken along line 5—5 in FIG. 4.
Figure 6A:
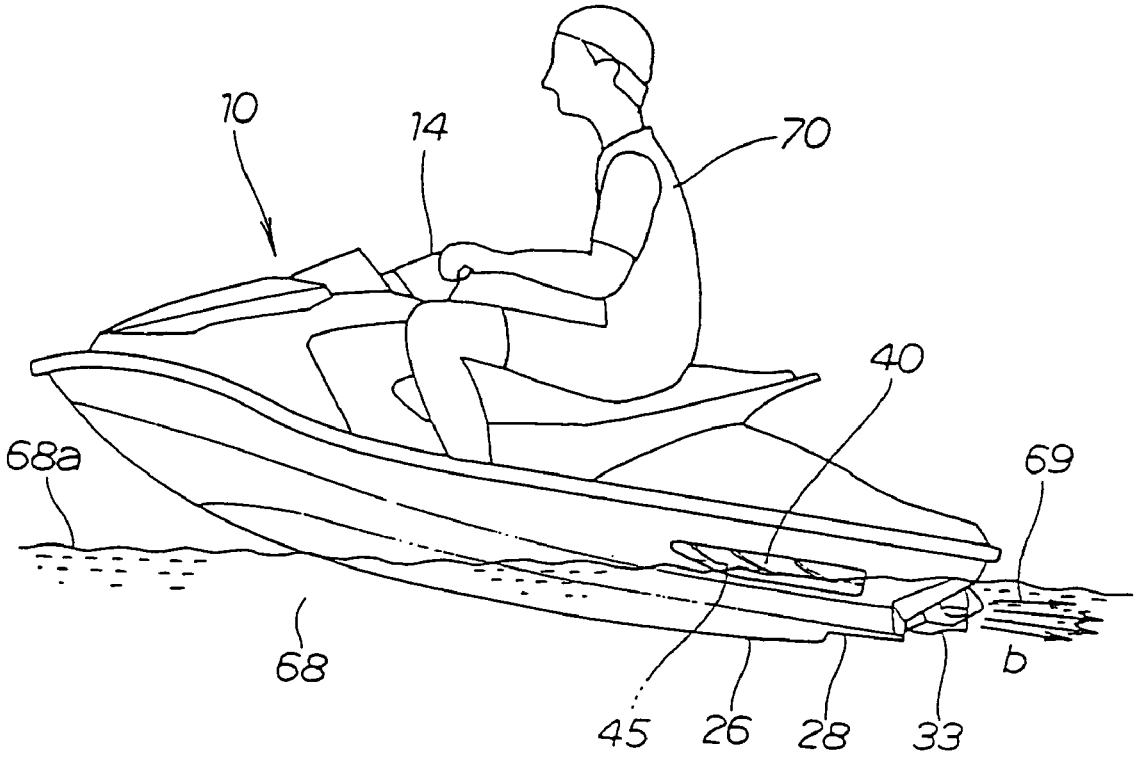
FIGS. 6(*a*)–(*b*) are views depicting an operating state in which a small boat of the present invention is moving.
Figure 6B:
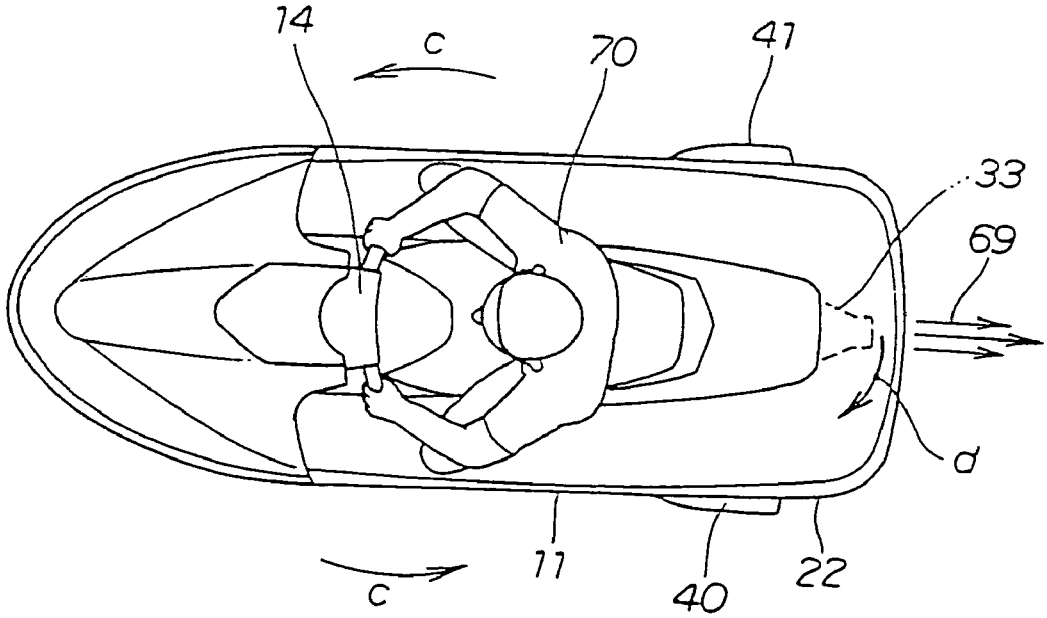
Figure 7A:
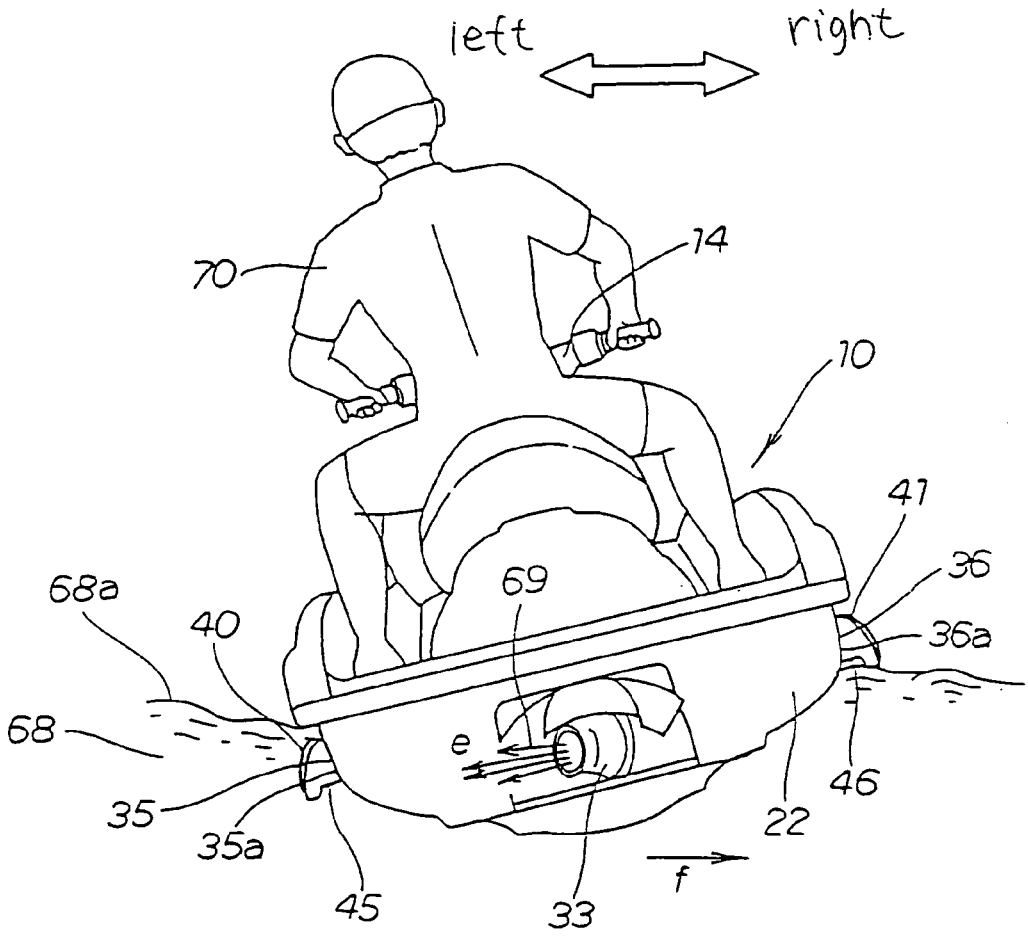
FIGS. 7(*a*)–(*b*) are views showing an operating state in which sponsons of the small boat of the present invention sink into the water.
Figure 7B:
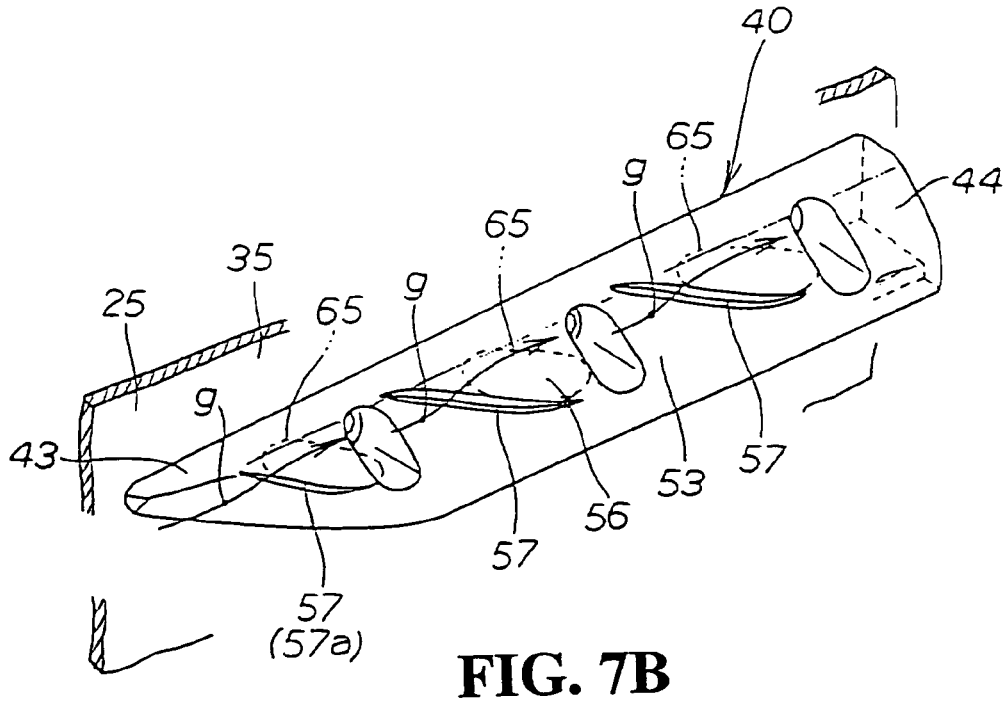
Figure 8A:
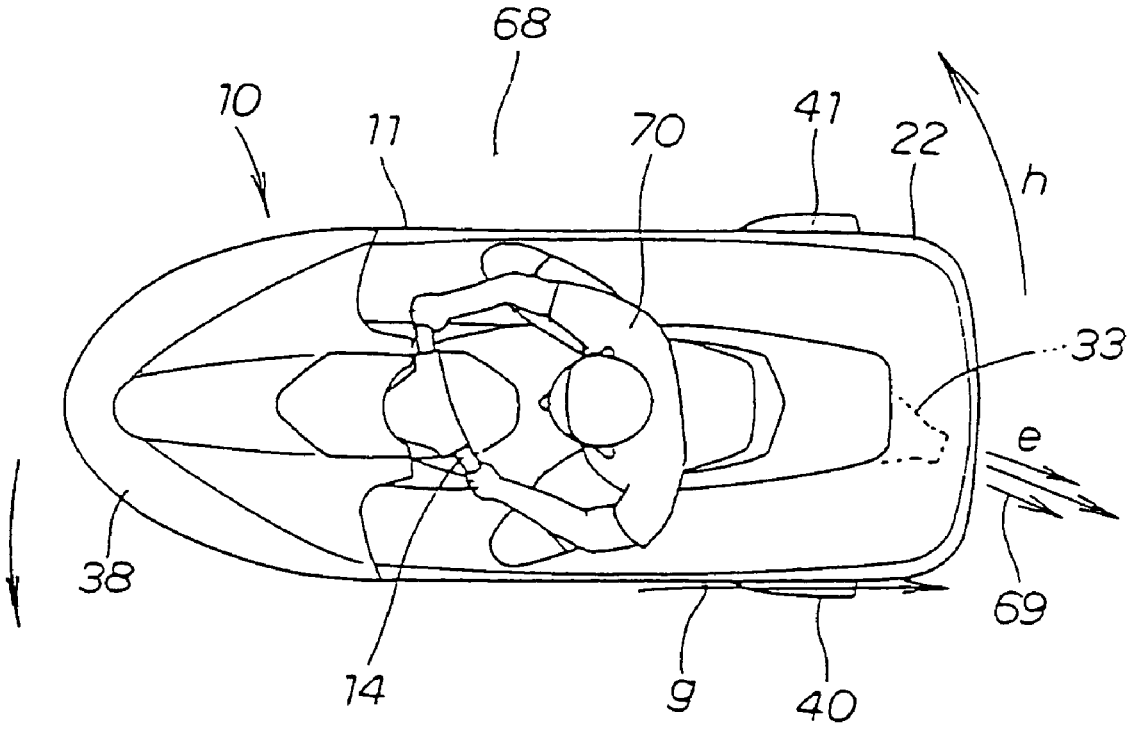
FIGS. 8(*a*)–(*b*) are views showing an operating state in which a small boat of the present invention is turning left.
Figure 8B:
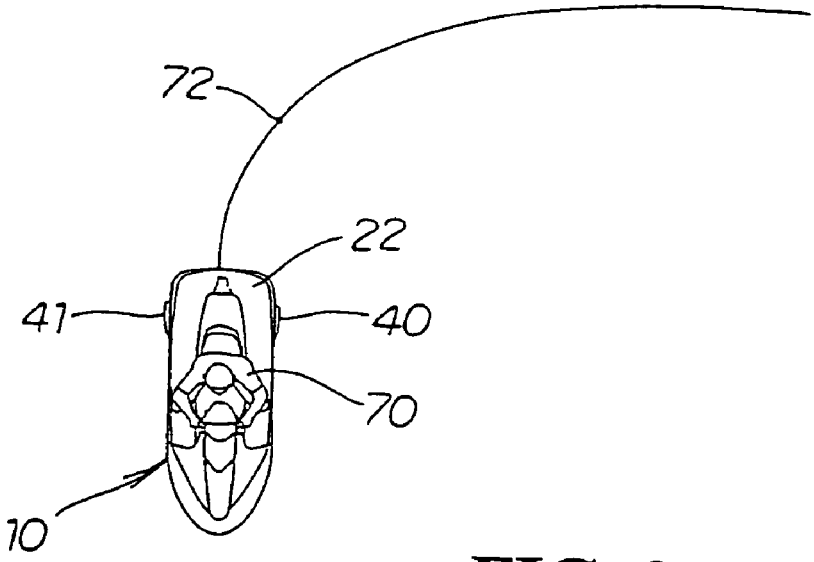
Figure 9:
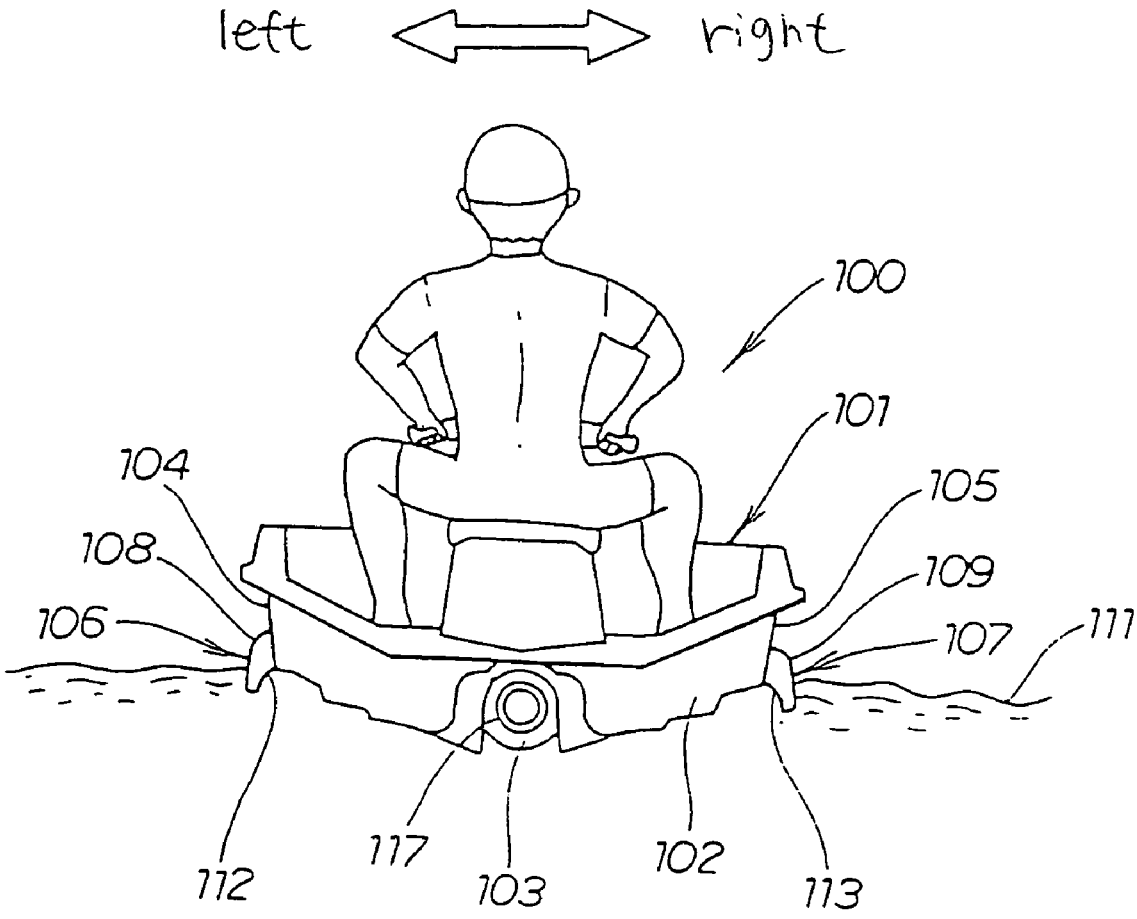
FIG. 9 BACKGROUND ART
FIG. 9 is a view showing a basic structure of a small boat of the background art.
Figure 10A:
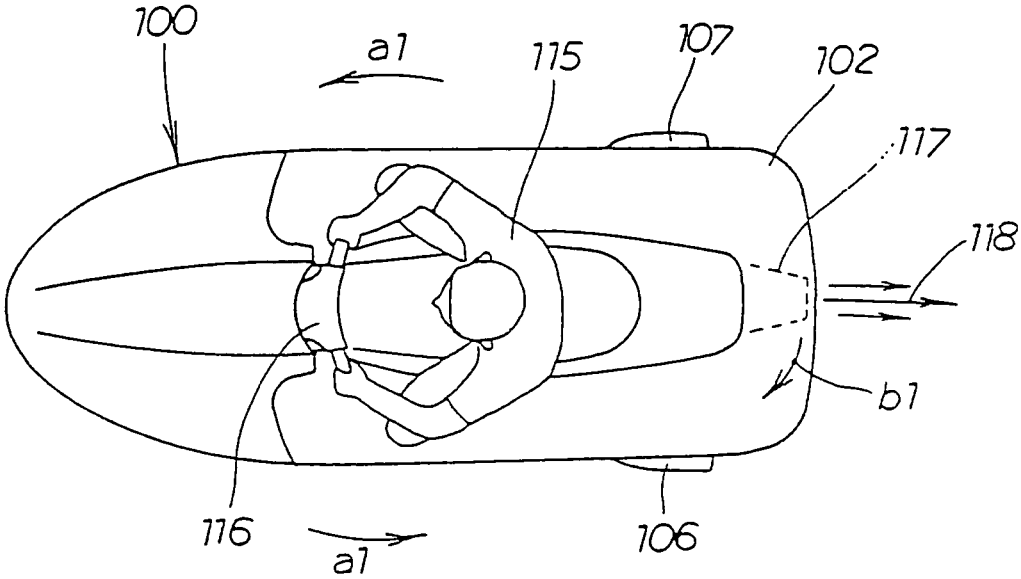
FIG. 10A BACKGROUND ART
FIGS. 10(*a*)–(*b*) are views showing an exemplary turning operation of the small boat of the background art.
Figure 10B:
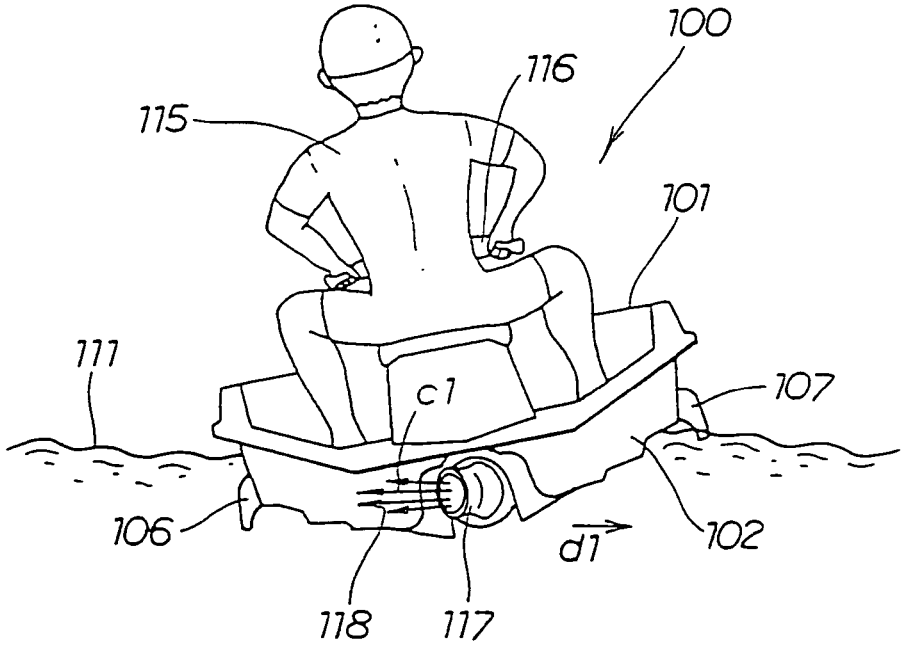
FIG. 10B BACKGROUND ART
Figure 11:
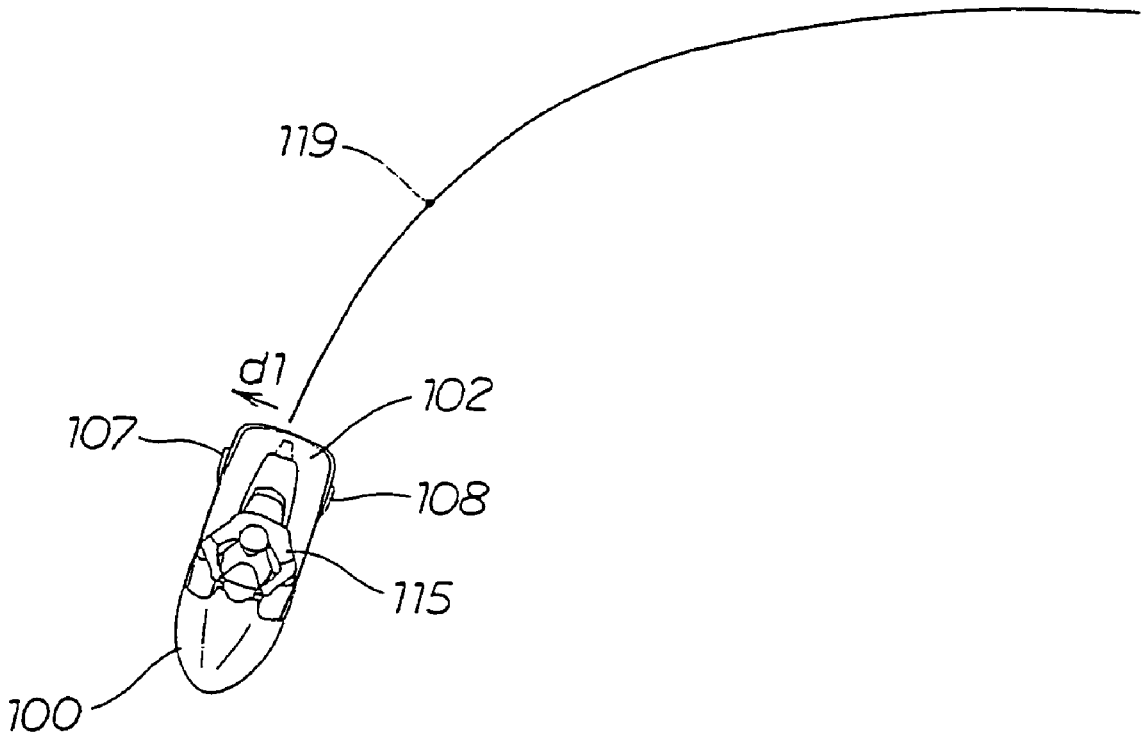
FIG. 11 BACKGROUND ART
FIG. 11 is a view showing an example of the small boat of the background art during a turning operation.

The present invention will hereinafter be described with reference to the accompanying drawings. FIG. 1 is a side view of a small boat according to an embodiment of the present invention. FIG. 2 is a side view showing portions of a small boat according to an embodiment of the present invention. FIG. 3 is a perspective view showing a sponson provided on a small boat according to an embodiment of the present invention. FIG. 4 is a side view showing a sponson provided on a small boat according to an embodiment of the present invention. FIG. 5 is a cross sectional view taken along line 5—5 in FIG. 4. FIG. 6 is a view depicting an operating state in which a small boat of the present invention is moving. FIG. 7 is a view showing an operating state in which sponsons of the small boat of the present invention sink into the water. FIG. 8 is a view showing an operating state in which a small boat of the present invention is turning left.

A preferred embodiment of the present invention will now be described in the following based on the attached drawings. The drawings should be viewed in a direction permitting a proper reading of the reference numerals provided therein. As seen in FIG. 1, the small boat 10 has a fuel tank 13 attached to a front part 12 of the boat body 11, and is provided with a steering handle above this fuel tank. A saddle type seat 15 is provided behind the steering handle 14, with an engine provided beneath the seat 15, a propulsion unit chamber 23 provided on a stem 22 behind the engine 16, and a jet propulsion unit 24 provided on the propulsion unit chamber 23. The body 11 forms a boat bottom 26 side with the hull 25, and a deck 27 overlaps this hull 25.

The jet propulsion unit 24 has a housing 29 extending rearward from an inlet 28 of the boat bottom 26. An impeller 31 is rotatably attached inside the housing 29, and the impeller 31 is connected to a drive shaft 32 of the engine 16. By rotating the impeller 31 with the engine 16, water is taken in from the inlet 28 of the boat bottom 26, and the water then passes through the housing 29 and is introduced to a steering nozzle as a water jet. The water jet that has been introduced to the steering nozzle 33 causes the small boat to travel by being sprayed from a rear end part of the steering nozzle 33.

FIG. 2 is a side view showing main parts of a small boat of the present invention. A boat bottom 26 side of the boat body 11 is formed by the hull 25, and left and right sponsons 40, 41 extending longitudinally are respectively attached to left and right side walls 35, 36 (refer to FIG. 7*a* for the right side wall 36) forming the hull 25. The right sponson 41 is shown in FIG. 6(*b*) and FIG. 7(*a*). By attaching the sponsons 40, 41 to the left and right side walls 35, 36, the left and right sponsons 40, 41 jut outwards from the respective side walls 35 and 36.

More specifically, the left sponson 40 is a hydrofoil-shaped member attached to a side from among rear sections 35*a* of the left side wall 35 close to the boat bottom 26 using one or more, but preferably three, bolts 42. Also, the right sponson 41 shown in FIG. 7(*a*) is a hydrofoil shaped member, the same as the left sponson 41 attached to a side from among rear sections 36*a* of the right side wall 36 close to the boat bottom 26 using one or more, but preferably three, bolts 42.

The left and right sponsons 40, 41 rise up from the water when the small boat travels in a straight line, and bottom surfaces of the left and right sponsons 40, 41, e.g., the gliding sections 45, 46 (refer to FIG. 7(*a*)), come into contact with the water surface. In this way, by causing the gliding surfaces 46 and 46 of the left and right sponsons to come into contact with the water surface, a large wetted surface area is ensured from the boat body when the small boat 10 is traveling. Since the left and right sponsons 40, 41 are symmetrical members, the left sponson 40 will be described in greater detail hereinafter but a complete description of the right sponson 41 will be omitted.

FIG. 3 is a perspective view showing a sponson provided on a small boat of the present invention. The sponson 40 is formed so as to extend rearwards from the front of the boat body 11, and is a hydrofoil-shaped member having a fine tip shape at the front end 43. This sponson 40 is provided with an attachment section 47 contacting a left side wall 35 of the hull 25, a gliding section 45 extending substantially horizontally from a lower edge 48 of this attachment section 47, a protruding section 52 protruding downwards from a side edge 51 of the gliding section 45, an inclined section 53 connecting to an upper edge 49 of the protruding section 52 and the attachment section 47, and three projecting sections 57 or ribs extending from an upper edge to a lower edge of the inclined section 53, and water flowing along the inclined sections 53 is guided by the projection sections 57 and removed from the inclined section 53.

Respective indents 61 for attachment are provided at front parts 53*a*, middle parts 53*b* and rear parts 53*c* of the inclined section 53, and attachment holes 62 (refer also to FIG. 5) are provided in the bottoms of the indents 61, e.g., in attachment sections 47. The bolts 42 are fitted into the attachment holes 62, and the fitted bolts 42 are fitted into attachment holes 63 of the left side wall 35. Nuts 64 (refer also to FIG. 5) are screwed on to the bolts 42 projecting to the rear side of the hull 25 to attach the sponson 40 to the left side wall. Bolts 42 and nuts 64 constitute attachment members for attaching the sponson 40 to the left side wall 35 of the hull 25.

The sponson 40 attached to the left side wall 35 with attachment members such as the nuts 64 and bolts 42, and the projection section 57 are provided in a manner that avoids interference with the bolts 42 (attachment members). By providing the projection section 57 in a position avoiding the positioning of the bolts 42 (attachment members) for attaching the sponson 40 in this way, it is possible to easily ensure a desired positioning of the projection sections 57.

The inclined section 53 is a member inclined at a downward gradient towards the lower edge 55 from the upper edge 54. Three projection sections 57 extending from an upper edge 54 to a lower edge 55 of the inclined section 53 are formed on the inclined section 53. The projection sections 57 are at fine streak shaped sites projecting to a specified height H (refer also to FIG. 5) from the rear surface 56 of the inclined section 53.

The projection sections 57 are members such as raised ribs formed with a downward gradient at an inclination angle of θ so as to extend rearwards from an upper edge 54 to a lower edge 55 of the inclined section 53 and formed to a length L. The height H, length L and inclination angle θ of the projection section 57 is appropriately selected according to the turning conditions of the small boat 10.

In this way, a plurality (3) of projection sections 57 are provided between the front end 43 and rear end 44 of the sponson 40. Among the plurality of projection sections 57, the projection section 57 arranged in the forward most row and provided at the front end of the sponson 40 (in the following, for convenience, the projection of the forward most row will be described as projection section 57*a*) is formed smaller than the other projection sections 57, 57 positioned to the rear of the forward most projection section 57*a*.

By making the front most projection section 57*a* smaller than the other two projection sections 57, 57, it is possible for water to flow smoothly to the rear of the sponson 40. Accordingly, it is possible to reliably remove water flowing along the inclined section 53 of the sponson 40 from the inclined section 53 by being favorably guided by the projection sections 57, 57 behind the front most projection section 57*a*. The reason that the inclined section 53 is inclined at a downward gradient towards the lower edge 55 from the upper edge 54, and the projection sections 57, 57 are formed projecting so as to extend rearward from the upper edge 54 of the inclined section 53 towards the lower edge 55 will be described in greater detail hereinafter.

FIG. 4 is a side view showing a sponson provided on a small boat according to an embodiment of the present invention. The sponson 40 is attached to the left side wall 35 of the hull 25 using bolts 42. By turning the small boat 100 to the left, the sponson 40 sinks into the water. At this time, water flows as shown by the arrows a, and is guided by the projection sections 57, 57 (including the front most projection section 57*a*), and rises up from the surface 56 of the inclined section 53. Therefore, it is possible to have separation layers 65 formed by small vortex currents formed at the rear of the projection sections 57, and in the separation layers 65 it is possible to remove water from the surface 56 of the inclined section 53.

By removing water from the inclined section 53 of the sponson 40, water resistance in the sideways direction with respect to the sponson 40 is kept small, and it is possible to suppress the extent of so-called grip with respect to water of the sponson 40. Accordingly, when causing the small boat 10 to turn, the rear of stern 22 of the boat body 11 (refer to FIG. 2) is made to move a comparatively large amount to an opposite side to the turning side, and it is possible for the small boat 10 to turn through a small arc turning locus.

However, in order to remove water flowing along the inclined section 53 of the sponson 40 from the inclined section 53 as a result of being guided by these projection sections 57 (including the projection section of the front most row), it is necessary to have water flow smoothly. Here, the inclined section 53 is inclined at a downward gradient towards the lower edge 55 from the upper edge 54, and the projection sections 57, 57 (including the projection section of the front most row) are formed projecting so as to extend rearwards from the upper edge 54 of the inclined section 53 towards the lower edge 55. By tilting the inclined section 53 at a downward gradient towards the lower edge 55 from the upper edge 54, water is guided in an outward direction by the inclined section 53. It is therefore possible to have a smoother, more laminar flow along the inclined section 53.

Also, by forming the projection section 57 so as to extend rearwards from an upper edge 54 to a lower edge 55 of the inclined section 53, the flow of water is not impeded by the projection sections 57. In this way, water flows smoothly along the inclined section 53, and the flow of water is not impeded by the projection sections 57, which means that water flowing along the inclined section 53 of the sponson 40 is guided by the projection sections 57 and it is possible to reliably remove water from the inclined section 53. Accordingly, when turning the small boat 10, the stern 22 of the boat body 11 (refer to FIG. 2) moves a comparatively large amount to an opposite side of the turning direction and it is possible for the small boat 10 to turn through a small arc turning locus.

FIG. 5 is a cross sectional drawing along line 5—5 in FIG. 4. Indents 61 are provided in the inclined section 53, and attachment holes 62 are provided in the bottoms of the indents 61, e.g., the attachment sections 47. Bolts 42 are fitted into the attachment holes 62, and the fitted bolts 42 are fitted into attachment holes 63 of the left side wall 35, and nuts 64 are screwed on to the bolts 42 projecting to the rear side of the left side wall 35 to attach the sponson 40 to the left side wall 35.

By attaching the sponson 40 to the left side wall 35 of the hull 25 using bolts 42, the attachment section 47 is brought into contact with the left side wall 35 of the hull 25. The gliding section 45 extends substantially horizontally from a lower edge 48 of this attachment section 47, with a protruding section 52 protruding downwards from a side edge 51 of the gliding section 45, the protruding section 52 and an upper edge of the attachment section 47 being connected by the inclined section 53. Accordingly, the gliding section 45 of the sponson 40 and the inclined section 53 extend outward from the left side wall 35. Three projection sections 57 (refer to FIG. 3 and FIG. 4) extend from an upper edge 54 to a lower edge 55 of the inclined section 53 extending from the left side wall 35.

Next, the operation of the sponson 40 provided in the small boat 10 of the present invention will be described in accordance with FIGS. 6–8. FIG. 6(*a*) and FIG. 6(*b*) are drawings for describing a state where a small boat of the present invention is moving. In FIG. 6(*a*), a jet propulsion unit 24 of the small boat 10 is driven by an engine 16 (refer to FIG. 1) to suck in water from an intake 26 at the boat bottom 26, and the sucked in water is sprayed to the rear in the direction of arrow b as a water jet 69 from the steering nozzle 33. The small boat 10 moves in a straight line as a result of the water jet 69 being sprayed.

As a result of the small boat 10 traveling in a straight line, the left and right sponsons 40, 41 (refer to FIG. 6(*b*) for the right sponson 41) rise up from the water surface 68*a*, and the gliding sections 45, 46 (the gliding section 46 is not shown in the drawings) of the left and right sponsons 40, 41 come into contact with the water surface 68*a*. Accordingly, the gliding surfaces 45 and 46 of the left and right sponsons come into contact with the water's surface, and a large wetted surface area is ensured from the boat body when the small boat 10 is traveling. In FIG. 6(*b*), during rectilinear movement of the small boat 10, a rider 70 operates a steering handle 14 as shown by arrows c to cause the steering nozzle 33 provided at the stem 22 of the boat body 11 to swing to the left side as shown by the arrow d.

FIG. 7(*a*) and FIG. 7(*b*) show an operational state where sponsons of the small boat of the present invention sink into the water. In FIG. 7(*a*)), as a result of swing movement of the steering nozzle 33 to the left side direction, the water jet 69 from the steering nozzle 33 is sprayed to the left side rear, as shown by arrow e. Accordingly, the stern 22 of the small boat 10 is made to move in the direction as shown by the arrow f, and begins to turn left. The small boat 100 then tilts to the turning side, e.g., to the left side and the left sponson 40 sinks into the water.

In FIG. 7(*b*), as a result of the sponson 40 sinking into the water, water 68 (refer to FIG. 7(*a*)) flows as shown by the arrows g, and is guided by the projection sections 57 (including the front most projection section 57*a*), and the water rises up from the surface 56 of the inclined section 53. Therefore, it is possible to have separation layers 65 formed at positions rearward of the projection sections 57. In the separation layers 65, water 68 is removed from the surface 56 of the inclined section 53. Accordingly, by removing water from the inclined section 53 of the sponson 40, the resistance of water 68 in the sideways direction with respect to the sponson 40 is kept relatively small, and it is possible to suppress the extent of so-called grip with respect to water of the sponson 40.

FIG. 8(*a*) and FIG. 8(*b*) show an operational state where a small boat of the present invention is turning left. In FIG. 8(*a*), by keeping the resistance of water 68 in a sideways direction with respect to the sponson 40 small, the stem 22 of the boat body 11 is caused to move a comparatively large amount as shown by the arrow h to a side opposite to the turning side under the power of the spray of the water jet 69. By causing the stern 22 of the boat body 11 to move as shown by arrow h, the bow of the boat body 11 is made to move as shown by arrow i.

In FIG. 8(*b*), by causing the stem 22 of the boat body 11 to move a relatively large amount, the small boat 10 turns through a small arc turning locus, e.g., through a small turning locus 72. Therefore, it is possible to apply the small boat 10 to situations that require a tight turning capability. In contrast, the projections sections 57 are not provided in the sponsons of the background art, and it is difficult to remove water from the inclined section of the sponsons. Therefore, the water resistance in the sideways direction with respect to the sponsons becomes relatively large in the sponsons of the background art, and the so-called grip effect with respect to water of the sponsons is increased. Therefore, an amount of movement of the stern is kept relatively small, and the small boat is required to turn through a large arc. Accordingly, it is necessary to apply the small boat to situations that require relatively large turning circle capability.

With the above described embodiment, a description has been given of an example where the small boat 20 of the present invention has been applied to a small propelled craft provided with a jet propulsion unit 24 at a rear part of the boat body 11, but the invention is not thus limited and can be applied to other small boats or watercraft.

Also, three projections sections 57 are provided on the inclined section 53 of the sponson 40 in the exemplary embodiment described hereinabove, but the number of projection sections is not limited to three and it is possible to provide one, two or four or more projection sections 57. Also, the shape of the projection sections 57 is not limited to the examples in the described embodiment, and appropriate modifications are possible. In short, any shape is possible as long as it is possible to remove water from the inclined sections 53 of the sponson 40.

Also, with the above described embodiment, description has been given of an example where bolts 42 and nuts 64 are used as attachment members for attaching the sponson to the left side wall of the hull 25. However, the attachment members are not limited to these types of fasteners and it is possible to use other members as the attachment members. The present invention is particularly beneficial for small boats having left and right sponsons attached to left and right side walls which form the boat body.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A watercraft comprising:

a boat body having left and right side walls extending longitudinally from a front and a rear portion of the boat body;

a right side sponson extending longitudinally along the right side wall; and a left side sponson extending longitudinally along the left side wall, wherein said left and right sponsons include:

attachment sections contacting the respective side walls, runner sections projecting substantially horizontally from a lower edge of the attachment sections, inclined sections connecting to a side edge of the runner sections and an upper edge of the attachment sections, and at least one projection section projecting upwardly from the inclined sections, wherein water flowing along the inclined sections separates from the inclined sections by being guided by the projecting sections, and wherein the at least one projection section includes three separate and longitudinally spaced apart projection sections on each of said right and left sponson.

2. The watercraft according to claim 1, wherein the inclined sections are inclined at a downward gradient towards a lower edge of the inclined sections from an upper edge of the inclined sections.

3. The watercraft according to claim 2, wherein the projection section is formed projecting so as to extend rearwardly from an upper edge of the inclined sections toward a lower edge of the inclined sections.

4. The watercraft according to claim 3, wherein the three projection sections are provided between a front end and a rear end of each of said sponsons, said three projection sections including a forwardmost projection section, a rearwardmost projection section, and a middle projection section.

5. The watercraft according to claim 4, wherein the forwardmost projection section of said three projection sections on each of said sponsons is smaller in size than said rearwardmost projection section.

6. The watercraft according to claim 1, wherein the projection section is formed projecting so as to extend rearwardly from an upper edge of the inclined sections toward a lower edge of the inclined sections.

7. The watercraft according to claim 6, wherein the three projection sections are provided between a front end and a rear end of each of said sponsons, said three projection sections including a forwardmost projection section, a rearwardmost projection section, and a middle projection section.

8. The watercraft according to claim 7, wherein the forwardmost projection section of said three projection sections on each of said sponsons is smaller in size than said rearwardmost projection section.

9. The watercraft according to claim 1, wherein the at least one projection section is a raised rib extending outwardly from an outer surface of the respective right and left sponson.

10. The watercraft according to claim 1, wherein each of said sponsons is attached to the respective side wall with attachment members, and the projection section is provided on said respective sponson in a position that does not interfere with said attachment members.

11. A sponson of a watercraft, said sponson comprising:

an attachment section capable of contacting a respective side wall of the watercraft, a runner section projecting substantially horizontally from a lower edge of the attachment section, an inclined section connected to a side edge of the runner section and an upper edge of the attachment section, and at least one projection section projecting upwardly from the inclined section, wherein said at least one projection section is a raised rib extending rearwardly and at an angle with respect to a longitudinal waterline of said sponson, and wherein the at least one projection section includes three separate and longitudinally spaced apart projection sections.

12. The sponson according to claim 11, wherein the inclined section is inclined at a downward gradient toward a lower edge of the inclined section from an upper edge of the inclined section.

13. The sponson according to claim 12, wherein the projection section is formed projecting so as to extend rearwardly from an upper edge of the inclined section toward a lower edge of the inclined section.

14. The sponson according to claim 11, further including a recessed area for an attachment member, said recessed area being provided in a position between adjacent projection sections.

15. The sponson according to claim 11, wherein a plurality of the projection sections are provided between a front end and a rear end of said sponson, said projection sections including a forwardmost projection section and a rearwardmost projection section.

16. The sponson according to claim 15, wherein the forwardmost projection section of said plurality of projection sections on each of said sponsons is smaller in size than said rearwardmost projection section.

17. A sponson for a watercraft, said sponson comprising:

an attachment section capable of contacting a respective side wall of the watercraft, a runner section projecting substantially horizontally from a lower edge of the attachment section, an inclined section connected to a side edge of the runner section and an upper edge of the attachment section, a plurality of separate and longitudinally spaced apart projection sections projecting upwardly from the inclined section, and a recessed area on the inclined section for an attachment member, said recessed area being provided in a position between adjacent projection sections, wherein each of said plurality of separate and longitudinally spaced apart projecting sections is a raised rib extending rearwardly and at an angle with respect to a longitudinal waterline of said sponson.

* * * * *